United States Patent [19]

Falkstein

[11] 4,258,842

[45] Mar. 31, 1981

[54] CAP DISPLAY PACKAGE

[76] Inventor: Frank B. Falkstein, P.O. Box 32705, San Antonio, Tex. 78216

[21] Appl. No.: 30,360

[22] Filed: Apr. 16, 1979

[51] Int. Cl.[3] ..... B65D 25/00

[52] U.S. Cl. ..... 206/45.34; 206/299; 206/806; 206/822; 229/16 D

[58] Field of Search ..... 206/45.34, 45.31, 7, 206/8, 9, 299, 297, 292, 462, 463, 822, 526, 806; 229/27, 16 D

[56] References Cited

U.S. PATENT DOCUMENTS

| | | | |
|---|---|---|---|
| 1,577,632 | 3/1926 | Coles | 206/8 |
| 2,343,189 | 2/1944 | Kaufman et al. | 206/8 |
| 2,764,280 | 9/1956 | Carper | 206/45.34 |
| 2,891,710 | 6/1959 | Repking | 229/16 D |
| 3,273,702 | 9/1966 | Palmer | 206/45.31 |
| 3,358,820 | 12/1967 | Fairbairn | 206/45.31 |
| 3,777,883 | 12/1973 | Hackenberg | 206/45.31 |
| 3,870,221 | 3/1975 | Zeitter | 206/45.31 |
| 3,904,029 | 9/1975 | Koltz | 206/45.34 |

FOREIGN PATENT DOCUMENTS

| | | | |
|---|---|---|---|
| 655998 | 8/1951 | United Kingdom | 206/45.34 |

*Primary Examiner*—Joseph Man-Fu Moy
*Attorney, Agent, or Firm*—Gunn, Lee & Jackson

[57] ABSTRACT

A display container for caps having transparent panels. The package frame is constructed from a single blank of sheet material, which has been cut to allow folding into a rectangular box with a protruding vertical rear double panel. The dimensions of the box are designed to accomodate a cap (headwear worn by men and women) such that the bill of the cap fits securely within the rear double panel. A large window space is cut out of the box and rear double panel and is covered with a transparent plastic material. The display package completely contains the cap and also prominantly displays the front and the bill of the cap.

7 Claims, 5 Drawing Figures

CAP DISPLAY PACKAGE

BACKGROUND OF THE INVENTION

The invention relates to visual display packages and, more particularly, to visual display packages designed to display caps (headwear worn by men and women). Visual display packages are necessary for many reasons. First, it is necessary to package the caps to prevent them from being damaged or soiled during their transportation, storage and display. While ordinary square cardboard boxes or other types of packages fulfill these functions, they often frustrate the potential purchaser's desire to examine the cap. Packages which are entirely opaque discourage purchases and require the purchaser or sales person to open the package and remove the cap if the purchaser is to be allowed to examine the cap. When this is done, the cap is no longer protected and may become soiled or damaged so that subsequent potential purchasers will prefer not to buy the cap. Further, such packages are commonly constructed from inexpensive materials, such as cardboard, and constant opening and closing of the packages leads to unsightly wear and tear or even destruction of the packages.

Alternatively, the caps can be permanently taken out of such packages and placed upon a display table or counter. This raises the possibility of the caps being spoiled by the customer. Furthermore, there is a limited number of ways in which unpackaged caps can be effectively displayed. An effective means of both protecting and storing the product, but still allowing the potential customer to examine the product, is needed.

BRIEF DESCRIPTION OF THE PRIOR ART

The packaging technique which is generally utilized to deal with the above problems is that of visual display packages. A wide variety of cardboard or paper boxes have been produced in which the front or other portions of the package are cut away to form a window. These windows are typically, although not necessarily, covered with a transparent plastic-like material which both protects the product and allows the consumer to inspect it. These containers come in many shapes and sizes. Normally, however, they basically utilize a square or rectangular design. This design is encouraged by the simplicity of fashioning such containers from a single sheet of cardboard and by the ease of stacking such containers upon each other. Zeitter, U.S. Pat. No. 3,870,221, discloses a simple, rectangular box having a window covered with a transparent film. While this design is effective for transporting and storage, it is not particularly well adapted to modern marketing display techniques. Boxes, such as those disclosed by Koltz, U.S. Pat. No. 3,904,029, and Palmer, U.S. Pat. No. 3,273,702, disclose improvements or variations upon the box-like structure of Zeitter. Both Palmer and Koltz contain rear display panels. These panels may be used for many purposes. They provide a convenient place for attaching the packages to display racks as is shown by the hole in Koltz. Furthermore, such rear display panels may be profitably used to advertise the product. Fairbairn, U.S. Pat. No. 3,358,820, discloses a slightly different way of visually displaying the product. Fairbairn completely encases the product between a transparent outer film and a cardboard base and back.

None of the visual display packages discussed, however, are designed to efficiently accomodate caps. They are all basically minor variations of the typical rectangular container with an aperture covered by a transparent film for visual examination of the contents. While they may efficiently display rectangular objects, they are ill-suited to the display of caps.

In order to store a single cap without crushing it, two types of storage areas must be provided. The crown of the cap may be stored within a square or rectangular box without an inordinate amount of wasted space. The bill of the cap, however, being a long, flat, wide projection which is attached to the crown, makes storage in a rectangular type box impractical. Even the most efficient design of rectangular boxes would waste far too much space within the box to be practical. In fact, to store a cap in a rectangular box would require approximately twice as much interior space than a close fitting sack would require to encompass the same cap.

Besides being impractical, a rectangular box does not efficiently display a cap. The ornamentation upon a cap typically consists of a colored bill and a medallion or design upon the front of the crown. Because the front of the crown and the top of the bill are perpendicular to each other, it is practically impossible to properly display a cap from within a rectangular box. No matter how the cap is arranged within the rectangular box, neither the bill of the cap nor the front of the crown can be placed directly adjacent to a transparent window for close inspection.

SUMMARY OF THE INVENTION

The present invention utilizes a design for a visual display package which is novel to the visual display package art. As is typical with present visual display packages, a rectangular box constructed from a cardboard sheet and transparent plastic material is used. The present invention discloses a visual display package design containing a flat, double-walled enclosure with a display window thereon as an integral part of the otherwise rectangular visual display package.

It is the object of the present invention to provide a visual display package for caps which will efficiently display the cap contained therein.

It is another object of the present invention to provide a visual display package which contains a cap with a minimum amount of wasted interior space.

It is yet another object of the present invention to produce a visual display package having the foregoing advantages and yet capable of being simply and cheaply manufactured from a single sheet of cardboard-like material and a smaller sheet of transparent material. The packages must be relatively simple to set up, be filled, and closed so as to enable them to be used in conjunction with assembly line methods.

It is yet another object of the present invention to produce a visual display package which provides as an integral portion thereof a hang tag or display card by which the package and cap may be advantageously displayed.

A further object of the present invention is to provide a package which gives satisfactory protection to the cap at all times.

It is yet another object of the present invention to provide a package which is easily handled and stored.

DESCRIPTION OF THE PREFERRED EMBODIMENT

Figure 1:
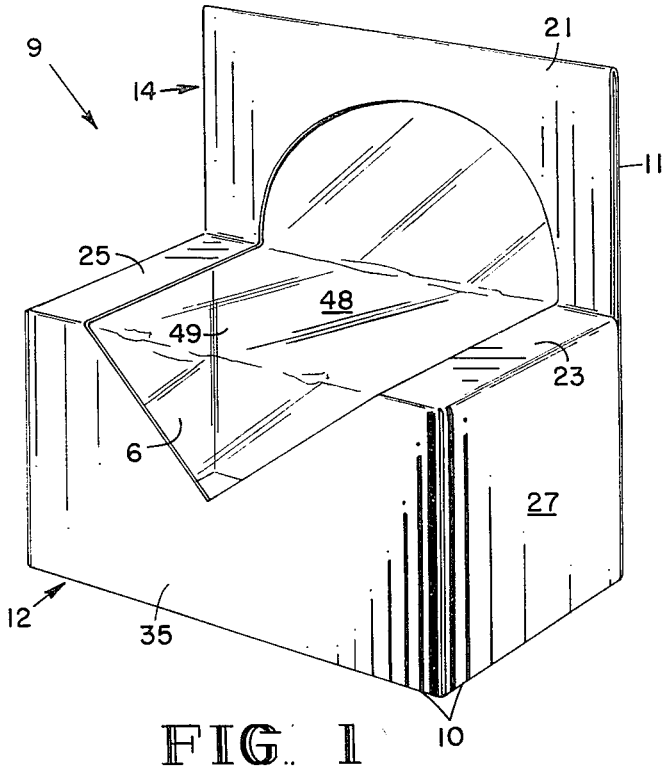
FIG. 1 is a perspective view of a visual display package.

Referring to FIG. 1 of the drawings, there is shown an assembled visual display package 9. The frame 10 may be composed of cardboard or a cardboard-like sheet material and is generally shaped into a lower rectangular portion 12 and an upper flat portion 14. A window 48 is shown as being cut from both the lower rectangular portion 12 and the upper flat portion 14. A transparent material 49, such as plastic or a cellulose base material, may be affixed within the frame 10 so as to entirely cover the window portion 48 of the frame 10.

Alternatively, the frame 10 may be composed of any material suitable for constructing a visual display package 9 of the type described herein. Further, it may not always be necessary to use a transparent material 49 to cover the window 48. In some circumstances, for example, it may be desirable to allow the purchaser to touch the contents of the visual display package 9. These types of options will be discussed in further detail after the basic visual display package 9 has been described.

Figure 2:
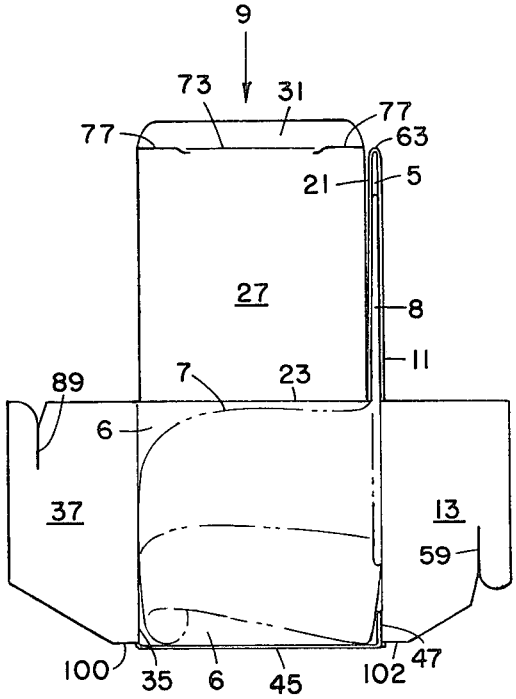
FIG. 2 is a side view of the visual display package shown in FIG. 1 with an end open to illustrate placement of a cap therewithin.

Referring to FIG. 2 of the drawings, it is seen that a main cavity 6 and a projecting cavity 5 are present within the visual display package 9. The crown of a cap 7 fits securely within main cavity 6 and the bill 8 of the cap 7 fits securely within the projecting cavity 5. Thus it is shown that a complete cap may be fitted within the visual display package 9.

It is to be understood throughout that the direction "lower" will mean toward the base of the visual display package 9. The terms "right" and "left" will be determined from the point of view of a person facing the visual display package and located directly behind the rear panel 11 of the assembled visual display package 9.

Figure 3:
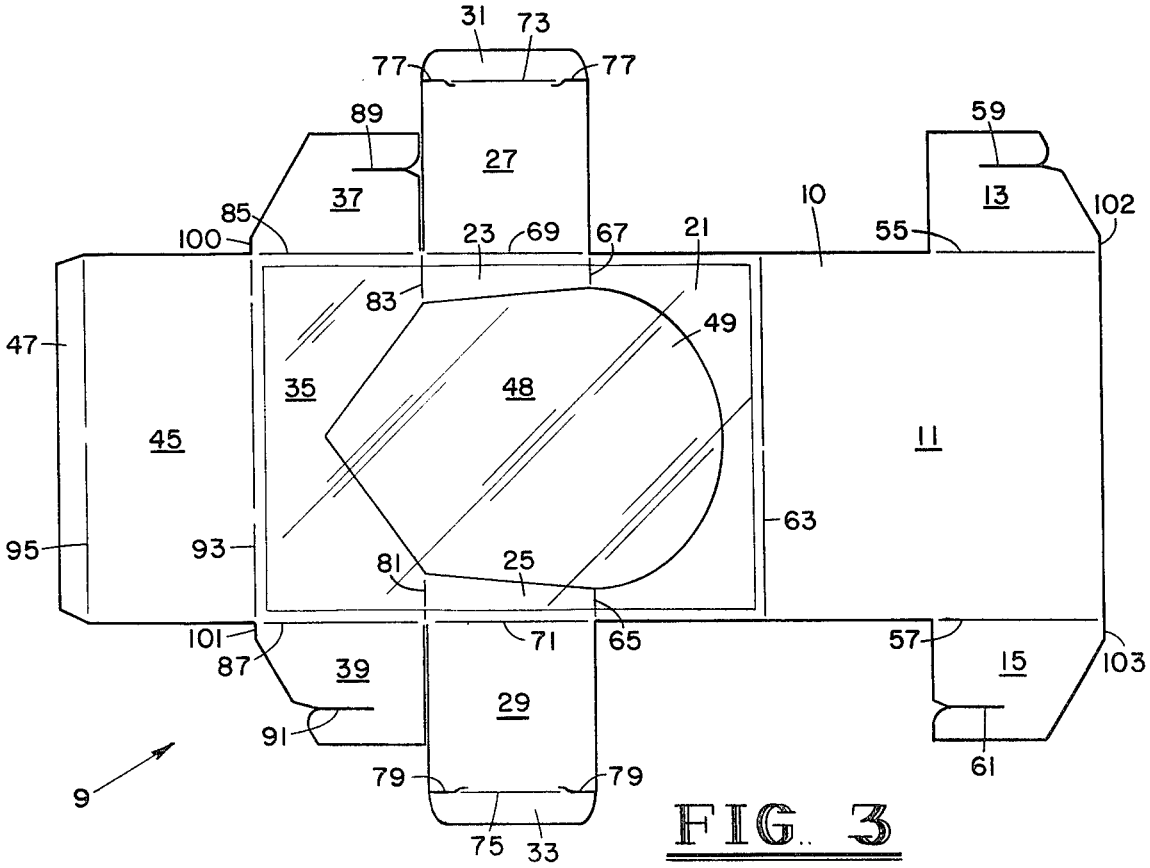
FIG. 3 is a plain view of the paper board material from which the visual display package may be formed.

Referring to FIG. 3 of the drawings, there is shown an unassembled visual display package 9. The visual display package 9 is basically composed of the frame 10 and a transparent sheet material 49. A window 48 is cut from the frame 10 and is located as shown in FIG. 3. Subsequently, transparent material 49 is affixed to frame 10 in a manner which will cover the window 48 in the frame 10. The transparent material 49 is normally affixed to the inner side of the frame 10.

It is seen that the frame 10 is composed of a flat sheet-like material having a generally rectangular shape. Base panel 45 is separated from the main body of the frame 10 by base panel fold line 93. The base panel 45 additionally consists of a base flap 47. The base flap 47 is somewhat tapered at each transverse side and is separated by base flap fold line 95 from the main body of the base panel 45.

The lower front panel 35 is adjacent to base panel 45 and is separated therefrom by base panel fold line 93. Two front flaps 37 and 39 are attached to the lower front panel 35, one to each transverse side of the lower front panel 35 as is shown in FIG. 3. Lower front panel 35 is connected to left front flap 37 by left front flap fold line 85, and is connected to right front flap 39 by right front flap fold line 87. The left front flap 37 contains a cut 89, and the right front flap 39 contains a cut 91. Lower front panel 35 is connected to right upper front panel 25 and left upper front panel 23 by fold lines 83 and 81, respectively.

The left upper front panel 23 is connected to a left side panel 27 by left side panel fold line 69. The main body of left side panel 27 is connected to a left side panel flap 31 by fold line 73. Similarly, right upper front panel 25 is connected by a fold line 71 to right side panel 29, which in turn is connected by fold line 75 to a right panel flap 33. Small locking cuts 77 and 79 are made upon fold lines 73 and 75, respectively. The locking cuts 77 and 79 are located upon the outer ends of fold lines 73 and 75.

A face panel 21 is connected to right upper front panel 25 and left upper front panel 23 by fold lines 65 and 67, respectively. The opposite edge of the face panel 21 is connected to a rear panel 11 by means of a fold line 63. A left rear flap 13 and right rear flap 15 are attached to rear panel 11 by means of fold lines 55 and 57, respectively. Left rear flap 13 and right rear flap 15 contain cuts 59 and 61, respectively, located as shown in FIG. 3.

Referring to the flaps 37, 39, 13 and 15, it is seen in FIG. 3 that all appear to be roughly square with the exception of having a major portion of one side shaved off. The small remaining unshaved portion of each flap, locking edges 100, 101, 102, and 104 located as indicated in FIG. 3 are useful in constructing the visual display package 9 as will be explained below.

Window 48 is cut from the interior of the frame 10 and is located as shown in FIG. 3. Window 48 separates the upper front panel into a left upper front panel 23 and a right upper front panel 25, and carves a substantial portion out of face panel 21.

To construct the visual display package 9 from the frame 10 as described above, the first step is to affix base flap 47 to the bottom of rear panel 11. This can be seen by referring to FIG. 2. This may be accomplished by a number of methods, gluing or stapling being the most common. Upon connecting the two far ends of the frame 10, the base flap 47 and the rear panel 11, it is seen that the frame 10 may be readily folded into the configuration shown in FIG. 2. It is only necessary to press the face panel 21 against the rear panel 11 and the general configuration desired results. Lower front panel 35, face panel 21, and rear panel 11 are each vertical and parallel to each other. Base panel 45, left upper front panel 23, and right upper front panel 25 are each horizontal and parallel to each other. As may be seen by observing FIGS. 1 and 2, a large main cavity 6 is thus formed between base panel 45, lower front panel 35, upper front panels 23 and 25, and rear panel 11. Additionally, a projecting cavity 5 is formed between rear panel 11 and face panel 21. This projecting cavity 5 is flat and narrow. Due to one of its parallel walls, the rear panel 11, being an extension of a wall from the lower rectangular portion 12, the projecting cavity 5 is necessarily parallel to the back wall of the main cavity 6. It is seen in FIG. 2, therefore, that the crown of a cap 7 may comfortably rest within the main cavity 6 and the bill 8 of the cap 7 may fit securely within projecting cavity 5 with a minimum of wasted space.

Because fold lines 95, 93, 81, 67 and 65, have been added to the frame 10 prior to shaping it into a visual display package 9, the various angles made at the junctures of the various panels may be made approximately 45° and a clean box-like appearance presented. Preexisting fold line 63 makes it possible to fold face panel 21 and rear panel 11 into a close parallel relationship without a protruding budge being created near the axis of the fold.

Left front fold 37 and left rear fold 13 are shown in FIG. 2 prior to their having been acted upon. When left front fold 37 and left rear fold 13 are both bent in toward the center of the visual display package 9, it becomes possible to insert the left front fold 37 within the cut 59 of the left rear fold 55. Likewise, it is possible to insert the left rear fold 55 within cut 89 of left front fold 37. These insertions are accomplished simultaneously by forcing the two flaps together so that the cut of each fold fits within the cut of the opposite fold. This is accomplished by temporarily pushing fold lines 83 and 38 inward toward fold base flap 47 so that left front flap 37 is forced below left rear flap 13. By performing the above described operations upon the visual display package 9 as shown in FIG. 2, it can be seen that flaps 37 and 13 can thus be joined together. Left front flap 37 and left rear fold 13 are thus securely interlocked with each other.

The same type of operation is undertaken to interlock the right front fold 39 with the left rear fold 11. Cuts 91 and 61 upon the righthand folds are, however, located upon the opposite edge of their respective right folds 39 and 11 than cuts 89 and 59 were to their respective left folds 37 and 13. The process of interlocking upon the right side is thus the inverse of the one used upon the left side. Fold line 93 is temporarily pushed inward toward fold lines 67 and 69 so that the right rear flap 11 is forced below right front flap 39.

When all of the folds are thus interlocked together, the visual display package 9 independently retains its box-like structure as shown in FIGS. 2 and 1. Because the inverse motions needed to assemble the visual display package 9, it is extremely unlikely that it will collapse.

After the flaps have all been secured, the left side panel 27 as shown in FIG. 2 may be moved into position. The left side panel flap 31 is inserted between the locking edges 100 and 102 of the left flaps 37 and 13, respectively, and the upper portion of the base panel 45. The left side panel cuts 77 engage upon the locking edges 100 and 102 of the left flaps and thereby secure the left side panel 27. Thus secured, the left side panel 27 provides an additional means of retaining the left flaps 37 and 13 interlocked with each other and adds additional stability to the visual display package 9. Left side panel 27 also provides the visual display package 9 with a more pleasing outer appearance by hiding the interlocked left flaps 37 and 13 from the public view. Right side panel 29 is positioned over the right side flaps 39 and 15, and the right side panel cuts 79 engaged upon locking edges 101 and 103 in exactly the same manner.

The result of the above operations is a visual display package 9 of the configuration shown in FIG. 1. The box can be additionally secured by either gluing or stapling the outer edges of the face panel 21 to the outer edges of rear panel 11. It is not anticipated that this will be necessary, however. The transparent material 49 used to cover the window 48 is flexible enough to have survived the above manipulations of the frame 10 to which it is attached without damage.

Figure 4:
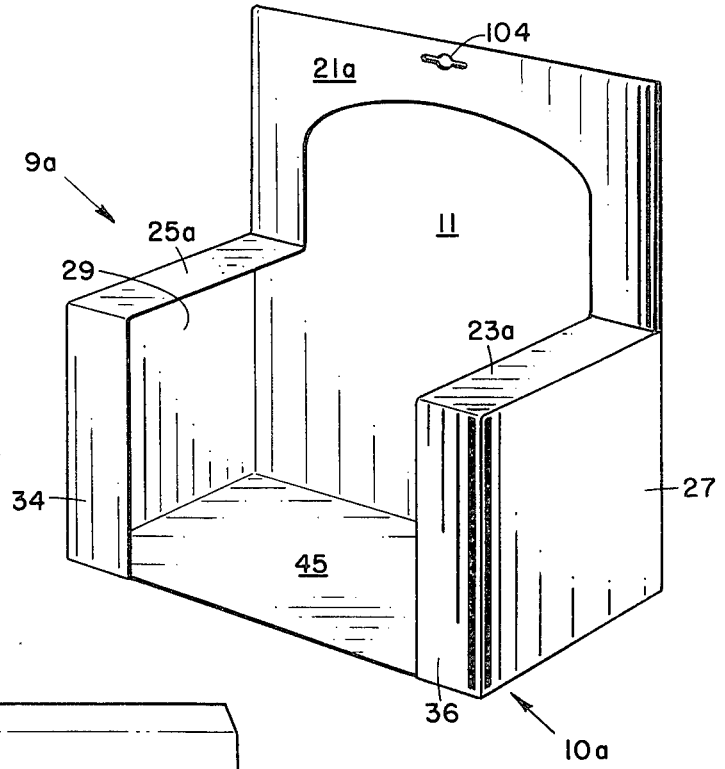
FIG. 4 is a perspective view of a modified version of the visual display package.
Figure 5:
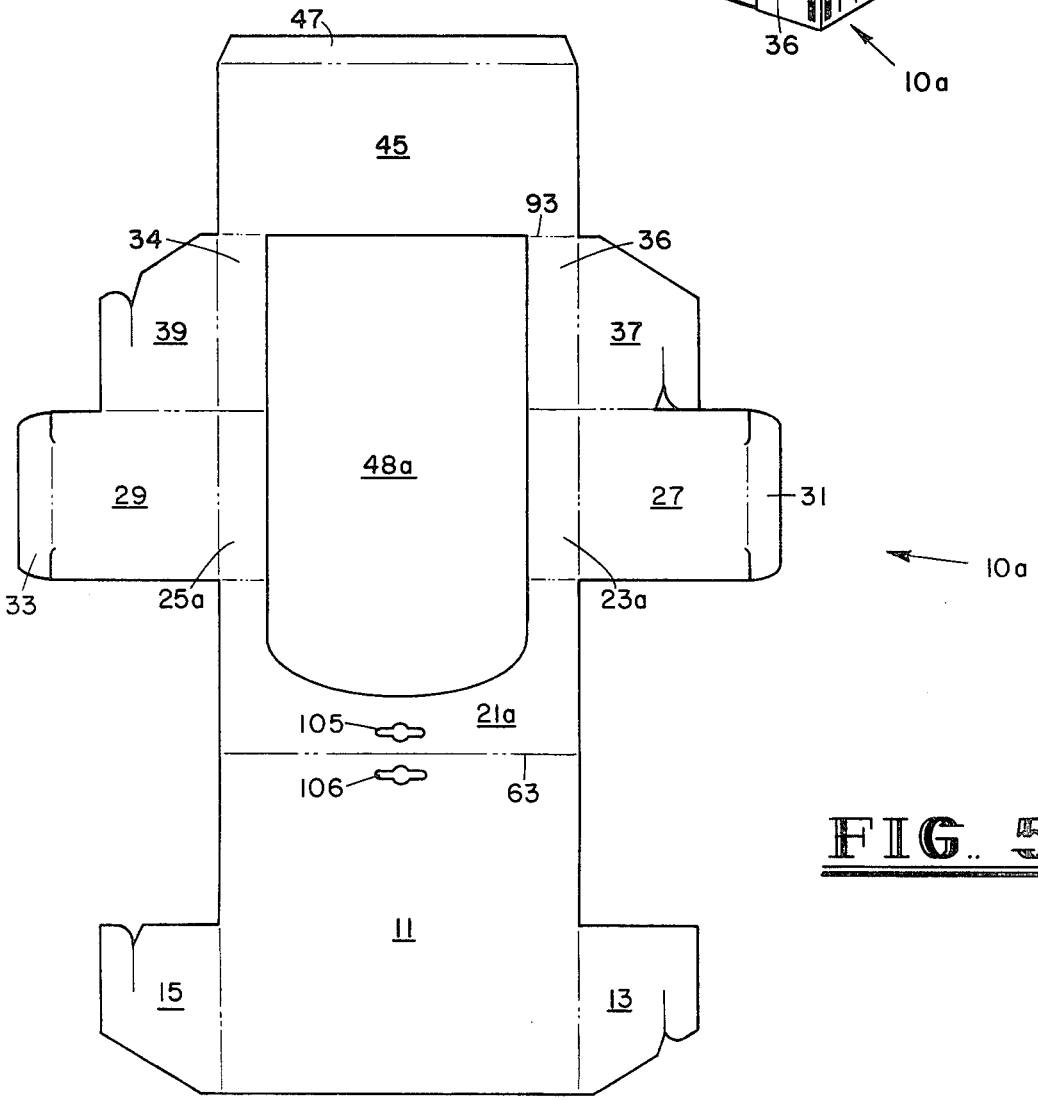
FIG. 5 is a plain view of the paper board material from which the modified visual display package of FIG. 4 may be formed.

FIG. 4 shows modified visual display package **9*a* which is similar to the visual display package 9 shown in FIG. 1. FIG. 5 shows the modified frame 10*a* used to construct the modified visual display package 6. Referring to FIG. 5, it is seen that the rear panel 11, base panel 45, flaps 37, 13, 39 and 15, and the side panels 27 and 29 are identical to those shown in FIG. 3. The face panel 21*a* is different from base panel 21 only in the manner in which the window 48*a* has been cut from it. The upper front panels 5*a* and 3*a* are identical to the upper front panels 25 and 23 of FIG. 3 with the exception that the configuration of window 48*a* is cut from them in a different manner than the window 48 of FIG. 3**.

A left lower front panel 36 and a right lower front panel 34 have been created from previous lower front panel 35 by extending window **48*a* through the full width of the lower front panel 35. The window 48*a* as shown in modified frame 10*a* extends from bottom panel fold line 93 in a straight line until it reaches the upper portion of face panel 21*a* at which point it curves as shown and returns by a straight line to base panel fold line 93**.

An additional difference between visual display package 9 and modified visual display package **9*a* is that the modified visual display package 9*a* additionally contains a display rack punchout 104 as shown in FIG. 4. Referring to FIG. 5, it is seen that the display rack punchout 104 is formed by cutting corresponding display rack punchout holes 105 and 106 in face panel 21 and rear panel 11, respectively, both holes being an equal distance from fold line 63** and arranged to correspond with each other.

Either the visual display package 9 or the modified visual display package **9*a* may be used. The major advantage of modified visual display package 9*a* is that window 48 of modified visual display package 9*a* is larger than window 48 of visual display package 9 and thus more prominantly features the cap within the package. The major advantage of visual display package 9, on the other hand, is that by retaining a single continuous lower front panel 35, a sturdier and longer lasting package is produced than that of modified visual display package 9*a***.

It is thus seen that a novel means of visually displaying caps from within these storage containers has been shown. Tens of thousands of caps are sold yearly in the United States alone and numerous companies make packages for storing and displaying caps. The applicant is unaware of any of these components in the highly competitive packaging industry ever suggesting or using a visual display package 9 of the type described above.

I claim:

1. A blank for a visual display package for displaying a cap having a bill and a crown, said blank comprising a piece of material foldable to form said package including:

a. a face panel having a lower front panel, a front panel, upper front panel, and a window aperture located therein, said lower and upper front panels being connected to said front panel by a pair of spaced apart fold lines;

b. a base panel having a base flap and connected to said lower front panel of said face panel by a base panel fold line;

c. a rear panel connected to said upper front panel of said face panel by a fold line;

d. front flaps located opposite each other and connected to said lower front panel of said face panel by front flap fold lines, said front flaps having one edge aligned with one of said spaced apart fold lines on said face panel and the opposite edge aligned with said base panel fold line;

e. side panels located on opposite sides of said face panel and connected to said face panel by side panel fold lines, said side panels having one edge aligned with one of said spaced apart fold lines on said face panel and the opposite edge aligned with the remaining spaced apart fold line on said face panel;

f. rear flaps located on opposite sides of the lower portion of said rear panel and connected to said rear panel by rear panel fold lines; said face panel when folded along said spaced apart face panel fold lines forms the top of a rectangular main cavity and one wall of a flat, narrow projecting cavity, said rear panel when folded along said rear panel fold line forms a second wall of said projecting cavity and the back of said rectangular main cavity, and said base panel when folded along said base panel fold line forms the bottom of said rectangular main cavity and engages a rear edge of said folded rear panel, said front flaps, said side panels and said rear flaps when folded along appropriate fold lines enclose the sides of said rectangular main cavity and thereby form said visual display package, said cap contained in said package capable of being viewed through said window aperture.

2. The blank of claim 1 wherein said window aperture provides direct access to said projecting cavity and said main cavity.

3. The blank of claim 1 wherein said window aperture is covered with a translucent material.

4. The blank of claim 3 wherein said translucent material is a thin, flexible plastic-like substance.

5. The blank of claim 1 wherein located in the upper front panel of said face panel and lower portion of said rear panel are punchout holes, said holes being equal distance from said rear panel fold line and arranged to correspond to each other.

6. The blank of claim 1 wherein when folded into said visual display package said lower front panel, said upper front panel, and said rear panel are vertical and parallel to each other and said base panel and said front panel are horizontal and parallel to each other.

7. The blank of claim 1 wherein said front flaps, said rear flaps and said side panels contain locking cuts that cooperate to secure the end closure of said rectangular main cavity.

* * * * *